US005390012A

United States Patent [19]

Miyashiro et al.

[11] Patent Number: 5,390,012

[45] Date of Patent: Feb. 14, 1995

[54] IMAGE FORMING APPARATUS HAVING TRANSFER MATERIAL CARRYING MEMBER

[75] Inventors: Toshiaki Miyashiro, Ichikawa; Haruo Fujii, Yokohama; Toshihiko Ochiai, Tokyo, all of Japan

[73] Assignee: Canon Kabushiki Kaisha, Tokyo, Japan

[21] Appl. No.: 992,773

[22] Filed: Dec. 18, 1992

[30] Foreign Application Priority Data

Dec. 25, 1991 [JP] Japan ..... 3-357054
Oct. 30, 1992 [JP] Japan ..... 4-316462

[51] Int. Cl.[6] ..... G03G 15/14
[52] U.S. Cl. ..... 355/273; 355/277
[58] Field of Search ..... 355/275, 274, 273, 271, 355/277

[56] References Cited

U.S. PATENT DOCUMENTS

| | | | |
|---|---|---|---|
| 3,702,482 | 11/1972 | Dolcimascolo et al. | 355/271 |
| 3,993,021 | 11/1976 | Kline | 118/651 |
| 4,162,843 | 7/1979 | Inoue et al. | 355/274 X |
| 4,522,866 | 6/1985 | Nishikawa et al. | 428/216 |
| 4,674,860 | 6/1987 | Tokunaga et al. | 355/274 |
| 5,038,178 | 8/1991 | Hosoya et al. | 355/277 |
| 5,084,735 | 1/1992 | Rimai et al. | 355/271 |
| 5,119,139 | 6/1992 | Torisawa | 355/272 |
| 5,276,490 | 1/1994 | Bartholmae et al. | 355/274 |

FOREIGN PATENT DOCUMENTS

| | | |
|---|---|---|
| 0323252 | 7/1989 | European Pat. Off. . |
| 50-93437 | 7/1975 | Japan . |
| 51-59636 | 5/1976 | Japan . |
| 54-1638 | 1/1979 | Japan . |
| 55-31557 | 8/1980 | Japan . |
| 60-232563 | 11/1985 | Japan . |
| 2156271 | 6/1990 | Japan . |
| 2156272 | 6/1990 | Japan . |
| 2156273 | 6/1990 | Japan . |
| 2156274 | 6/1990 | Japan . |
| 2156275 | 6/1990 | Japan . |
| 2156276 | 6/1990 | Japan . |
| 2156277 | 6/1990 | Japan . |
| 2291578 | 12/1990 | Japan . |
| 3154085 | 7/1991 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus includes an image bearing member; an image forming device for forming a toner image on the image bearing member; a transfer material carrying member for carrying a transfer material, wherein the toner image is electrostatically transferred onto the transfer material carried on the transfer material carrying member, wherein the transfer material carrying member has a dielectric layer carrying the transfer material and a supporting member for supporting the transfer material through the dielectric layer, wherein a gap is provided between the dielectric layer and the supporting member. Alternatively disclosed is a transfer material carrying member formed of a support layer, an elastic layer on top of the support layer, an intermediate layer on top of the elastic layer, and a dielectric layer on top of the intermediate layer.

56 Claims, 8 Drawing Sheets

IMAGE FORMING APPARATUS HAVING TRANSFER MATERIAL CARRYING MEMBER

FIELD OF THE INVENTION AND RELATED ART

The present invention relates to an image forming apparatus for transferring a toner image formed on an image bearing member onto a transfer material carried on a transfer material carrying member, and more particularly to a color electrophotographic apparatus.

In conventional color electrophotographic recording machines, respective color toner images are formed on an image bearing member in the form of a photosensitive member or drum, and are superposedly transferred onto the same transfer material or sheet, thus producing a color image on a transfer sheet.

As for a transfer device (overlaying transfer device) used in the color electrophotographic recording apparatus, the following types are known:

(1) As shown in Japanese Laid-Open Patent Application No. 232563/1985, a dielectric sheet is stretched to cover a circumferential opening of a drum, and a transfer sheet is electrostatically attracted on the dielectric sheet. The toner images are transferred from the image bearing member onto the transfer sheet on the dielectric sheet. This type is most widely used.

(2) The transfer sheet is held on a transfer drum having electrical conductivity or intermediate resistance and rotatable in press-contact with the image bearing member, and a bias voltage having an opposite polarity from the toner is applied to the transfer drum, so that the toner image is transferred from the image bearing member onto the transfer sheet. This type is further divided into the following types:

(2A) As for a transfer sheet holding means on the transfer drum, openings are provided at positions corresponding to the leading and trailing edges of the transfer sheet so that the air can be sucked at the leading and trailing edges of the transfer sheet. The transfer sheet is held on the transfer drum by sucking the air through the openings.

(2B) As disclosed in Japanese Patent Application Publication 31557/1980, the transfer sheet is overlaid onto the transfer drum, and the electric charge is applied to the transfer sheet, by which the transfer sheet is attracted onto the transfer drum by the electric charge on the transfer sheet.

(3) Japanese Laid-Open Patent Applications Nos. 156271–156277/1990, the transfer sheet is overlaid on a transfer sheet (dielectric sheet), and a plurality of electrodes are juxtaposed with predetermined spaces therebetween at a backside of the transfer sheet. The voltage is alternately supplied to these electrodes, thus holding the transfer sheet on the transfer sheet carrying sheet.

The above conventional transfer devices involve the following drawbacks.

The type (1) is good at holding the transfer sheet on the dielectric sheet. However, the dielectric sheet has a .small thickness such as 50–300 microns, and therefore, the rigidity thereof is not high. Therefore, if the dielectric sheet is used for a long term, it is easily damaged. In the actual transfer device, the dielectric sheet is required to be exchanged for every 10,000 copies. The exchanging manipulation requires skilled expert because the new dielectric sheet is easily bent or scratched.

The type (2A) is excellent for retention of the transfer sheet. However, the air sucking operation results in noise production, bulky apparatus and limitation to the usable size of the transfer sheet. Therefore, this type is employed in limited machines.

The type (2B) is advantageous in that the structure of the transfer drum is simple and in that the mechanical strength is good. However, it is easily influenced by ambient condition change such as temperature and/or humidity change. Particularly under the high humidity condition, the transfer operation is not satisfactory. When plural color toner images are transferred onto the transfer sheet, the transfer positions of the toner images are not registered. Even if a gripper is used to mechanically hold the transfer sheet in a part of the transfer drum in order to prevent the misregistration, it is difficult to put the device into practical use.

The type (3) is preferable from the standpoint of holding the transfer sheet on the transfer sheet carrying sheet. However, because of the necessity for the electrodes on the carrying sheet and for the power supply device (electrode) for the application of the voltage to be electrode, the transfer material carrying sheet is costly, and the electrode structure is complicated. Additionally, the material of the electrodes are not stable from the standpoint of assuring the durability against the wearing. Therefore, it is also difficult put this type device in practice.

SUMMARY OF THE INVENTION

Accordingly, it is a principal object of the present invention to provide an image forming apparatus capable of carrying a transfer material on a transfer material carrying member.

It is another object of the present invention to provide an image forming apparatus in which the deterioration of the transfer material carrying member is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
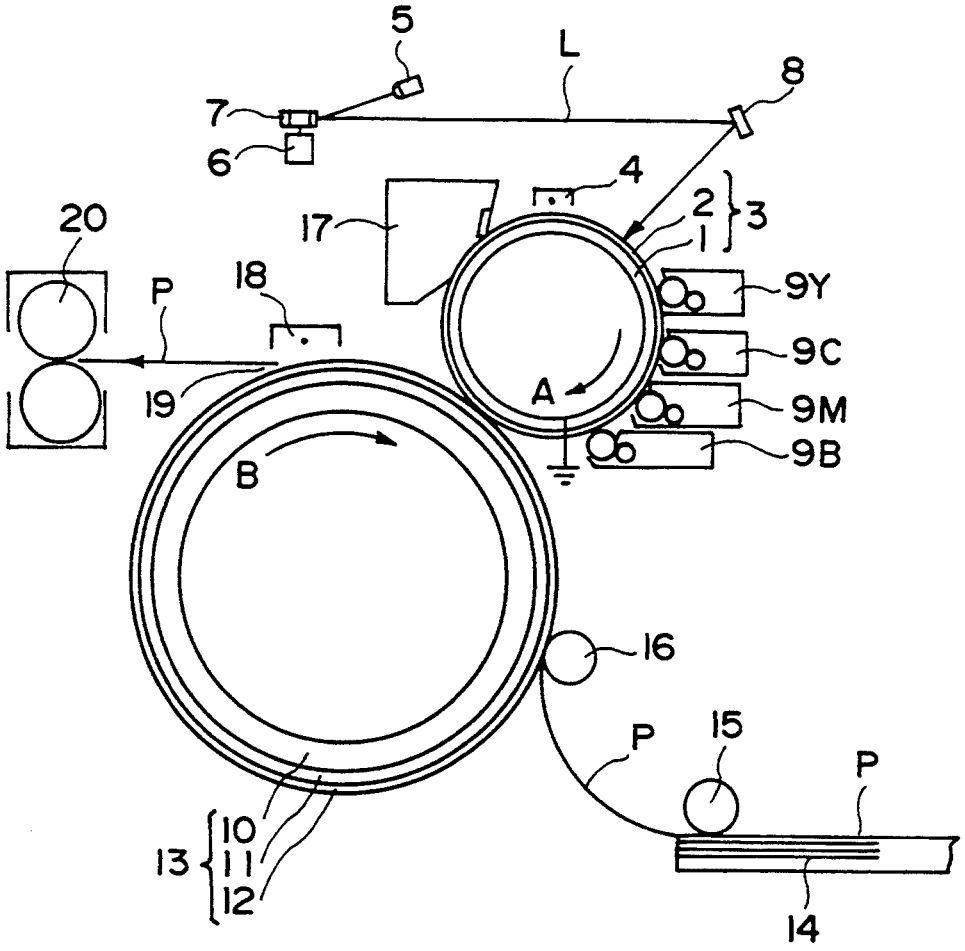
FIG. 1 is a sectional view of an image forming apparatus provided with a transfer device according to an embodiment of the present invention.
Figure 2:
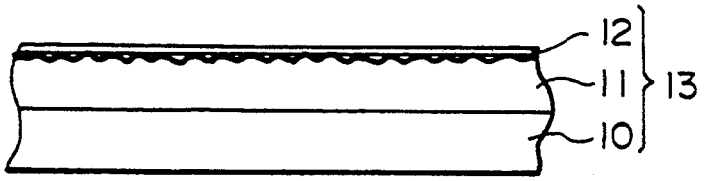
FIG. 2 is a sectional view illustrating the structure of a transfer drum of the transfer device of FIG. 1.

FIG. 1 shows a color image forming apparatus provided with an image transfer device according to an embodiment of the present invention. FIG. 2 is a sectional view of a transfer drum used in the transfer device of the image forming apparatus shown in FIG. 1. The image forming apparatus is a laser beam printer in this embodiment.

The image forming apparatus comprises an image bearing member including a conductive base in the form of an aluminum cylinder 1 having a diameter of 60 mm, and a photosensitive layer 2 applied or evaporation thereon and made of organic photoconductor (OPC), zinc oxide (selenium compound or amorphous silicon). In this embodiment, the image bearing member 3 comprises the photosensitive layer 2 in which OPC resin is dispersed. The image bearing member 3 is rotated at a peripheral speed of 63 mm/sec in a direction A by an unshown driving source. The surface of the image bearing member 3 is uniformly charged by a primary charger 4 to −600 V.

An yellow color image signal is supplied to a laser diode 5, which in turn produces image light L, which is in turn reflected by a polygonal mirror 7 rotated by a high speed motor 6. The reflected light is reflected by a folding mirror 8, and the image light is projected onto the image bearing member 3. By this, an electrostatic latent image is formed on the image bearing member 3 (the description of the optical lens or the like are omitted, since they are known).

The this formed electrostatic latent image is developed by an yellow developing device 9Y by any known developing means such as magnetic brush two component developing means, non-magnetic one component developing means, cascade developing means, patch-down developing means, powder cloud developing means or the like. Thus, an yellow toner image is formed on the image bearing member 3.

Where the image is developed through a socalled reverse development in which the toner charged to the same polarity as the primary charger charging polarity is deposited on the region exposed to the light, a DC voltage substantially equal to the potential of the image bearing member 3 after the charging is applied to the developing roller of the developing device 9Y as the developing bias. In this embodiment, the reverse development used, and non-magnetic one component developer is used. The DC voltage is biased with an alternating bias, so that the developing bias produces an alternating electric field.

In this embodiment, the transfer drum 13 comprises an aluminum cylinder 10 having a diameter of 120 mm, an elastic layer (elastic supporting layer) 11 in the form of a foamed urethane material having a thickness of 2 mm and wrapped on the aluminum cylinder, and a dielectric sheet of PVDF (polyvinylidene fluoride) having a thickness of 100 microns as a dielectric layer 12. The details of the transfer drum 13 will be described hereinafter.

A transfer sheet P is fed out of a paper cassette 14 by a roller 15, and the transfer sheet is attracted onto the transfer drum 13 by an attraction roller 16. Upon the attraction, a DC voltage of several hundreds−2 KV is applied between the attraction roller 16 and the transfer drum 13. The resistance of the attraction roller 16 is satisfactory if the resistance is substantially conductive resistance to $10^{10}$ ohm·cm, or the resistance permits the electric current enough to effect the attraction. For example, when the width of the transfer sheet P is 210 mm, the resistance is enough to flow several μA-several tens μA.

The transfer sheet P attracted on the transfer drum 13 is synchronized with an yellow toner image on the image bearing member 3 so that the leading edge thereof is aligned with the yellow toner image. In this embodiment, +1.4 KV having a polarity opposite from that of the toner is applied to the transfer sheet P so as to transfer the toner to the transfer sheet P.

On the image bearing member, residual toner remains after the image transfer. The residual toner is removed by a cleaning device 17 including a rubber blade fur brush or the like, and thereafter, the image bearing member 3 is again charged to a uniform potential by a charger 4. Similarly to the case of yellow image, another color toner image, cyan toner image, for example, is formed by latent image formation and the developing operation of the developing device 9C. The cyan toner image is transferred onto the transfer sheet P and overlaid on the already transferred Yellow toner image. In the similar manner, a magenta toner image and a black toner image are sequentially formed on image bearing member 3 through latent image formations by the magenta developing device 9M and black developing device 9B, respectively. They are also overlaid on the transfer sheet P, so that a color image is provided on the transfer sheet P in the form of superposed yellow toner, cyan toner, magenta toner and black toner images.

The transfer sheet P on the transfer drum 13, after completion of all of the toner image transfers, is electrically discharged by a separation discharger 18 capable of effecting AC discharging. Then, it is separated from the transfer drum 13 and is conveyed to an image fixing device 20 where the toner image on the transfer sheet P is heated and fused and fixed on the transfer sheet P as a permanent full-color image.

The description will be made as to the operation of the transfer drum 13 in the transfer device. Particularly, the improvement of the attraction force of the transfer sheet P onto the transfer drum 13 under a high temperature and high humidity condition (32.5° C. and 85%).

In this embodiment, as described hereinbefore, the transfer drum 13, as shown in FIG. 2, comprises an aluminum cylinder (drum) 10, an elastic layer 11 in the form of foamed urethane wrapped thereon and a dielectric layer 12 of PVDF sheet thereon.. Since the elastic layer 11 is formed with foamed urethane, a gap exists between the dielectric layer 12 and the elastic layer 11. Between the dielectric layer 12 and the elastic layer 11, there is no primer layer, and they are not bonded together. The drum, elastic layer and the dielectric layer are of laminated structure at least in the region carrying the transfer material.

Figure 3:
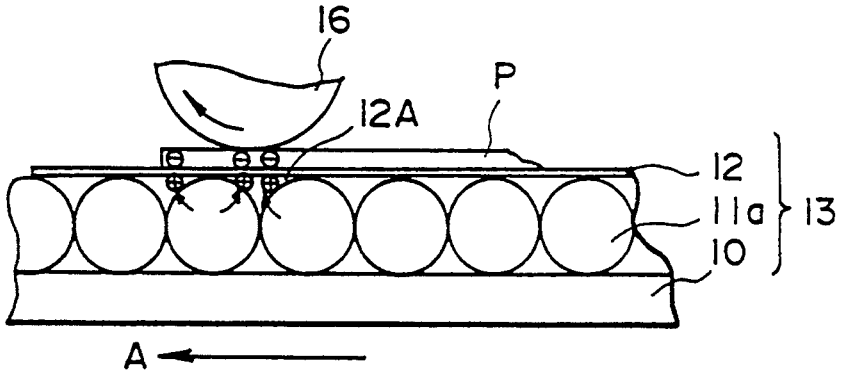
FIG. 3 is a sectional view of a transfer drum using copper powder as an elastic layer for illustration of the operation of the transfer drum of FIG. 2.

For the purpose of better understanding of the operation of the transfer drum 13 in this embodiment, the description will be made as to the case the elastic layer 11 is provided by copper powder 11*a* rather than the foamed urethane layer, as shown in FIG. 3. More particularly, mesh copper powder was used as the copper powder 11*a* in place of the elastic layer 11 of the foamed urethane material. The dielectric layer 12 was made of PVDF sheet having a volume resistivity of $10^{14}$ ohm·cm.

When 2 KV DC voltage is applied to the attraction roller 16 from an unshown voltage source (the polarity of the applied voltage is preferably changed depending on the polarity of the toner, and when the toner is charged to the negative polarity, the polarity of the voltage applied to the drum 10 of the transfer device 13 from the voltage source is positive, and therefore, the attraction roller 16 is preferably supplied with a voltage of the negative polarity), electric discharge occurs in the gap between the copper powder 11*a* and the dielectric layer 12 by the voltage. On the backside of the dielectric layer 12, electric charge is produced by the electric discharge in the gap 12A at the non-contact portion between the copper powder 11*a* and the dielectric layer 12, so that strong attraction force relative to the transfer sheet P is produced.

Figure 4:
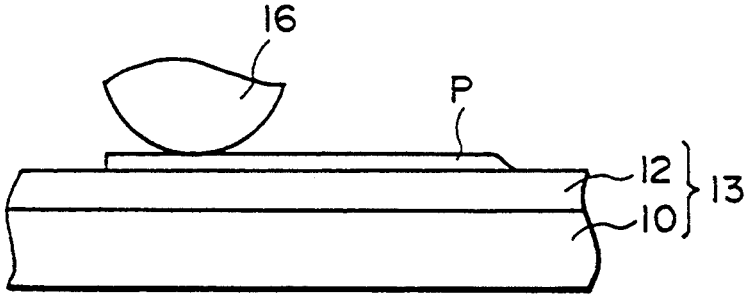
FIG. 4 PRIOR ART
FIG. 4 is a sectional view of a structure of a transfer drum not using the present invention.

Conventionally, as shown in FIG. 4, the conductive drum 10 is directly contacted to the backside of the dielectric layer 12 of the transfer drum 13, and therefore, the attraction of the transfer sheet P to the dielectric layer 12 has been very small under high humidity conditions, for the following reasons.

In order for the transfer sheet P to be attracted and retained on the transfer drum 13, the electric charge injected from the attraction roller 16 is required to be retained in the state uniformly distributed on the transfer sheet P, and the electric charge having the polarity opposite from that of the charge on the transfer sheet P, is required to exist on the backside of the dielectric layer 12 constituting the surface layer of the transfer drum 13, corresponding to the distributed electric charge.

However, in the case of the transfer drum 13 shown in FIG. 4, most of the electric charge injected for the purpose of attraction of the transfer sheet P is not retained on the transfer sheet P when it absorbs moisture. Rather, it moves to the surface of the dielectric layer 12. This is because of the movement of the electric charge between the transfer sheet P and the surface of the dielectric layer 12. The movement of the electric charge does not occur all over the surface of the transfer sheet P, but it is limited only to the region (charge moving region) on the transfer sheet P where the charge is most easily movable.

In other words, even in the case of the transfer sheet having absorbed the moisture and therefore having a low resistance, it is not easy to move the electric charge to the dielectric layer 12, and therefore, the portion tending to retain the electric charge (charge retaining portion) and a portion permitting movement of the electric charge to the dielectric layer (charge moving region), coexist on the transfer sheet.

What is ruling the charge movement mechanism is considered to be an air layer existing between the transfer sheet P and the dielectric layer 12 surface.

Figure 8:
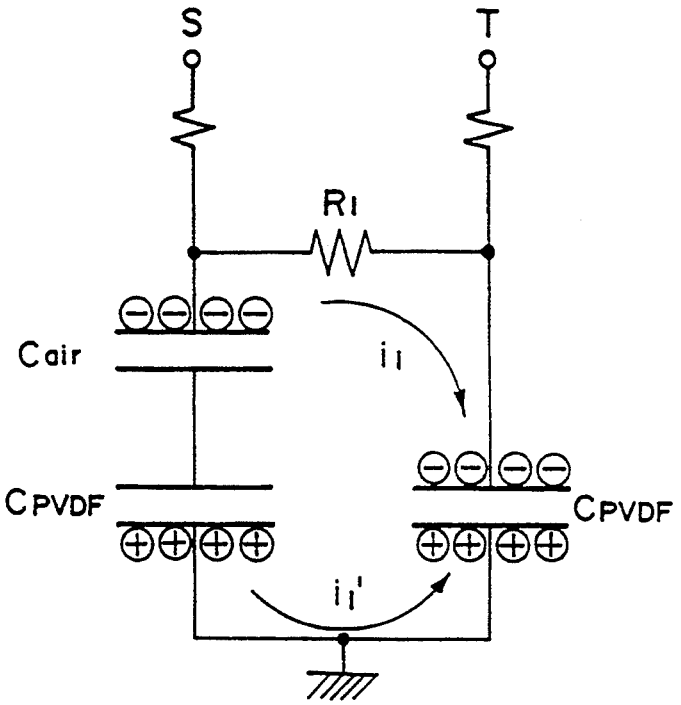
FIG. 8 PRIOR ART
FIG. 8 is an equivalent CR circuit for a charge retaining portion and a charge moving portion in the transfer drum of FIG. 4.

FIG. 8 shows an equivalent CR circuit of the charge retaining portion and the charge moving portion in the transfer drum 13 of FIG. 4. When attraction electric charge is injected by the attraction member through contacts S and T, in the left circuit (charge .retaining portion), the electric charge is once retained at the opposite ends of the gap capacitance $C_{air}$ and dielectric layer 12 capacitance $C_{PVDF}$ which are connected in series, but the charge flows into the light circuit (charge moving portion) through the transfer material resistance R1. The flow of the electric charge occurs more quickly when the resistance R1 is small, that is, when the transfer sheet P absorbs much moisture.

Therefore, in the transfer drum having the structure shown in FIG. 4 or corresponding to the equivalent circuit of FIG. 8, the electric charge to be retained on the transfer sheet for the purpose of attraction does not exist during the time period of image forming operation under the high temperature and high humidity condition with the result of insufficient sheet attraction.

Figure 7:
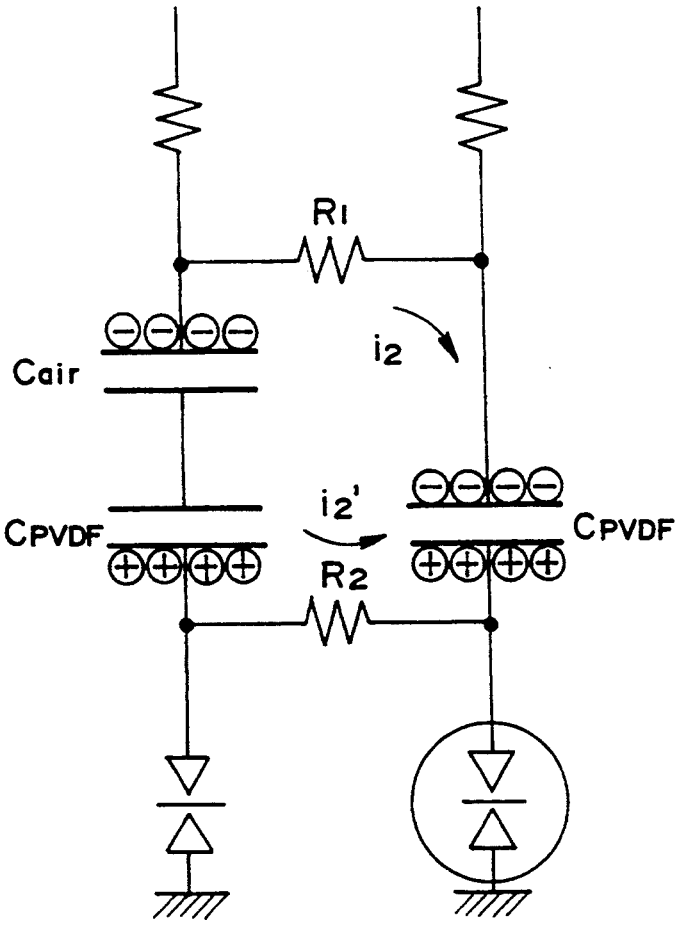
FIG. 7 shows an equivalent CR circuit for a charge retaining portion and a charge moving portion in a transfer drum of FIG. 3.

However in the structure of the transfer drum shown in FIG. 3, the equivalent CR circuit for the charge retaining portion and the charge moving portion is as shown in FIG. 7. The electric charge injected into the opposite ends of the gap capacitance $C_{air}$ and the dielectric layer 12 capacitance $C_{PVDF}$, does not quickly disappear through the light circuit. Thus, in order to retain the transfer sheet containing moisture, it is desirable that the resistance R2 is properly large so that motion of the electric charge along the surface of the backside of the dielectric layer 12 is limited. With the structure of FIG. 3, the electric charge having moved by the discharge from the copper powder 11*a* to the backside of the PVDF, is prevented from motion in the surface by the surface resistance of the backside of the PVDF. Therefore, the motion of the electric charge shown in FIG. 8 is retarded, and therefore, the attraction charge can be retained during the image formation period even if the transfer sheet absorbs the moisture. In FIG. 7, the signs representing the electric discharge in the gap, are enclosed with circles at the ground side.

It will be understood that the attraction force between the transfer sheet P and the dielectric layer 12 has conventionally been small under the high humidity condition.

Figure 5:
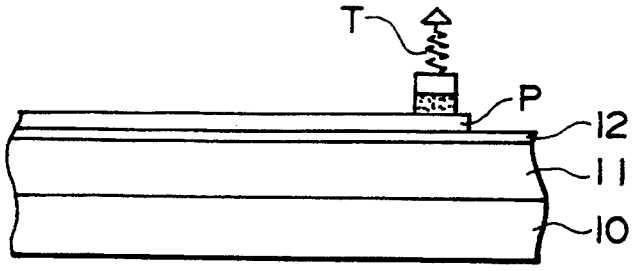
FIG. 5 illustrates measuring method for the attraction force for the photosensitive drums of FIGS. 3 and 4.

The experiments have been conducted to measure the attraction force between the dielectric layer 12 and the transfer sheet P attracted thereon, in the manner shown in FIG. 5, for the transfer drums 13 of FIGS. 3 and 4.

The used transfer sheet P was XEROX 4024 available from XEROX Inc. was used as the transfer sheet P. The electric charge was supplied to the top surface of the transfer sheet P by the attraction roller 16, so that the transfer sheet P is attracted on the dielectric layer 12. A spring balance T is bonded to an end portion of the attracted transfer sheet P by an adhesive. The transfer sheet P is pulled upwardly by the spring balance. The force required to peel the transfer sheet P is measured as the attraction force of the transfer sheet P to the dielectric layer 12.

In the conventional transfer drum 13 shown in FIG. 4, the attraction force was as small as 6 g. It is only one tenth the attraction force (70 g) in the case of the transfer drum of a color copying machine CLC 200 or CLC 500 available from Canon Kabushiki Kaisha, Japan. The transfer drum 13 of FIG. 3 exhibited the attraction force of 35 g, which is strong enough to practical use.

If the transfer sheet P is completely separated from the transfer drum 13, and thereafter, it is attached again to the transfer drum 13, the transfer sheet can be attracted again in the case of the transfer drum of CLC 200 or CLC 500 and the transfer drum of FIG. 3. However, in the case of FIG. 4 transfer drum, the attraction force hardly exists.

From the foregoing, it is considered that the discharge occurs in the gap 12A between the dielectric layer 12 and the copper powder 11*a* during the attraction, and the transfer sheet P is attracted and retained by the electric charge produced by the electric discharge action. When the dielectric layer 12 and the drum cylinder 10 are completely closely contacted, the electric charge moves through the dielectric layer 11 or a metal evaporated layer, with the result of small attraction force for the transfer sheet P.

Further experiments have been conducted to measure the attraction force for the transfer sheet P using a transfer drum having the basic structure shown in FIG. 2 and having the following parameters and conditions.

(1) Six elastic layers 11 having a thickness of 2 mm were prepared, one having a copper top surface mirror-finished, and the other having center line average surface roughness Ra 1 micron, 10 microns, 100 microns, 1 mm and 5 mm, respectively. As a dielectric layer 12, PVDF sheet of 100 microns thickness was used. The center line average roughness Ra was measured in accordance with JIS-B0601 by a surface roughness detector (Surfcoder SE-30H, available from Kabushiki Kaisha Kosaka Kenkyusho, Japan).

The elastic layers 11 were made of RUBYCELL (trade name available from Toyo Polymer Kabushiki Kaisha) and had a thickness of 2 mm. The surface roughness were 10 microns, 20 microns, 50 microns and 100 microns.

The center line average height (roughness) is defined as follows. From the roughness curve, a length to be measured (h=2.5 mm) in the direction of its center line, is sampled. The center line average height (Ra $\mu$m) is defined by $$Ra=\int_0^h |f(x)|\,dx$$

where f(x) is the roughness curve on the coordinates with X axis of the center line of the samples portion and Y axis of the longitudinal magnification direction.

(2) The electric layer 12 was made of PVDF, and was stretched thereon.

(3) The elastic layer 11 was of Moltopren USM (trade name) available from Koyo Kogyo Kabushiki Kaisha, Japan, having a thickness of 2 mm. The cell number was 55/25 mm. A dielectric layer 12 of PVDF was overlaid and stretched.

The attraction forces between the transfer sheet P and the transfer drums were measured. In the case of the mirror-finished surface in the elastic layer, the attraction force was too small to be practical, as described hereinbefore in conjunction with FIG. 4.

As for the case in which the elastic layer 11 is of copper plate having a roughened surface (Ra=1 micron), it is practically usable when the humidity is not more than 75%, although the attraction force is small under 85% humidity condition. It will be understood that if the surface roughness Ra exceeds a certain level, it is practically usable if the ambient condition is limited.

If the surface roughness of the copper plate of the elastic layer 11 is not less than 10 microns (Ra), the attraction force is practically sufficient level. However, if the thickness of the elastic layer 11 is as large as approx. 10 times the thickness of the dielectric layer 12, the resultant transferred image becomes non-uniform, and therefore, it is preferable for the elastic layer having a thickness of 100 microns that Ra is not more than 1 mm.

In the cases of the elastic layer 11 of RUBYCELL and Moltopren USM, the attraction of the transfer sheet was so satisfactory that it is practically usable even under high humidity condition. The electrostatic capacity of RUBYCELL was 1.36 pF/cm$^2$ and a resistance of 2000 M$\Omega$/10$\times$10 cm$^2$, and the Moltopren USM has an electrostatic capacity of 0.56 pF/cm$^2$ and a resistance of 20 M$\Omega$/10$\times$10 cm$^2$.

If the comparison is made among the copper plate, Moltopren and RUBYCELL, the Moltopren and RUBYCELL are preferable since uniform image transfer can be provided because the elastic layer 11 and the image bearing member 3 are uniformly contacted during the transfer action of the toner image from the image bearing member 3 onto the transfer sheet P.

In the foregoing, the dielectric layer 12 was of PVDF sheet having a thickness of 100 microns. The thickness of the dielectric layer 12 is selectable in a range of 10–500 microns. Thinner dielectric layer 12 is preferable from the standpoint of stronger attraction force and reduction of the transfer voltage.

The material of the dielectric layer 12 may be a high resistance urethane rubber material or PET (polyethylene terephthalate) or the like. The volume resistivity thereof is preferably not less than $10^{12}$ ohm·cm (not more than $10^{17}$ ohm·cm). In consideration of the influence of temperature or humidity or the cleaning of the surface or the like, it is preferably $10^{13}$–$10^{15}$ ohm·cm. The dielectric layer is so selected that it will have a volume resistivity larger than that of the elastic layer.

The elastic layer 13 may be an electrically conductive material or a material having a high resistance. However, if the elastic layer 11 is made of conductive material such as copper, there is a possibility of problem that the dielectric breakdown occurs in the elastic layer 11 by the transfer voltage or attraction voltage at a portion where the dielectric layer 12 has a pin hole or the like. On the other hand, if the volume resistivity becomes not less than $^{1013}$ ohm·cm as in the case of PVDF, the stronger electric discharge operation is required to separate the transfer sheet P from the transfer drum 13 after the image transfer operation with the result of bulky discharging apparatus. If the discharging is not sufficient, separation discharge or the like occurs upon the separating operation with the result of disturbance of the toner image on the transfer sheet P. For these reasons, the volume resistivity of the elastic layer 13 is preferably $10^4$–$10^{12}$, further preferably $10^8$–$10^{11}$ ohm·cm.

Figure 6:
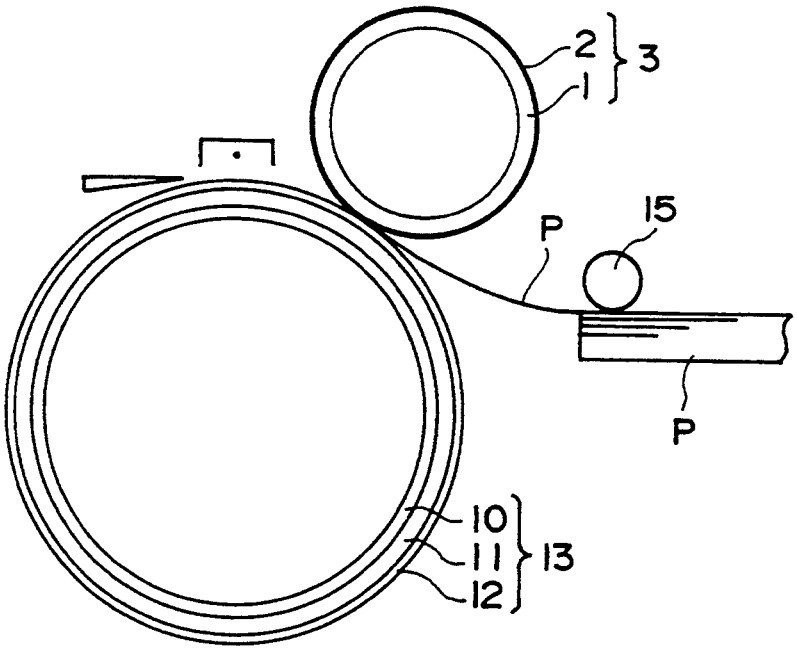
FIG. 6 is a sectional view of an image forming apparatus according to another embodiment of the present invention.

Referring to FIG. 6, another embodiment of the present invention will be described. In the image forming apparatus of this embodiment, the attraction roller 16 of the transfer device in FIG. 1 is omitted, so that the transfer sheet P is directly inserted into the transfer region between the transfer drum 13 and the image bearing member 3. In this case, the transfer current is used both to transfer the yellow toner image from the image bearing member 3 onto the transfer sheet P and to attract the transfer sheet P onto the transfer drum 13. The transfer sheet P is attracted by the electric charge of the transferred toner. The other structure of the apparatus of this embodiment is the same as in the transfer device of FIGS. 1 and 2, and therefore, the detailed description thereof is omitted for simplicity by assigning the same reference numeral as in FIGS. 1 and 2 to the element having the corresponding functions.

In this embodiment, the transfer sheet is directly inserted into the transfer region to use the transfer current both to transfer the toner image from the image bearing member 3 onto the transfer sheet P and to attract the transfer sheet P onto the transfer drum 13. The transfer drum 13, similarly, as in FIG. 2, has an elastic layer 11 of foamed urethane material or the like on a cylinder 10. It further comprises a dielectric layer 12 in the form of PVDF sheet wrapped thereon. By the formation of the elastic layer 11 of foamed urethane material or the like, a gap 12A is provided between the transfer drum and the dielectric layer 12. By the action of the transfer current, the electric charge is produced on the backside of the dielectric layer 12. Similarly to the case of using an attraction roller 16, the transfer sheet P can be strongly attracted and retained on the dielectric layer 12, and therefore, the same advantageous effects can be provided.

In the foregoing, the transfer sheet P is plain paper. If the transfer sheet P is a thick paper, for example not less than 105 g/cm$^2$, a conventional gripper or the like may be suitably used at a position abutted by the leading edge of the transfer sheet P, by which the thick transfer sheet P can be assuredly held on a transfer drum 13.

In order to produce electric discharge on the backside of the dielectric layer 12, the applied voltage to the attraction roller 16 is preferably not less than 400 V, further preferably not less than 500 V. In consideration of the dielectric breakdown of the dielectric layer 12, it is preferably not more than 10 KV. Further in consideration of the image disturbance due to the electric field produced by the toner, it is preferably not more than 4 KV.

By formation of the elastic layer 11 with foamed urethane material or the like, the gap is provided between the dielectric layer 12 and the elastic layer 11. However, the gap may be formed by providing pits and projections having a height of approx. 10 microns in place of the elastic layer 11 on the backside of the dielectric sheet constituting the dielectric layer 12. The material of the elastic layer 11 may be a woven cloth or the like.

In the foregoing, the thickness of the elastic layer 11 is 2 mm. From the standpoint of transfer performance, holding force and attraction force, the thickness of the elastic layer is preferably 0.5–5 mm, and further preferably 1.5–2.5 mm.

As described in the foregoing, by formation of elastic supporting layer in a transfer material carrying drum with foamed urethane or the like, a gap is formed between the drum and the dielectric layer of dielectric sheet. Therefore, the transfer material such as transfer sheet can be strongly attracted and retained electrostatically on the dielectric layer by the electric charge discharged by the attraction bias applied in the gap at the backside of the dielectric layer. The stabilized transfer condition can be maintained over a long period of time, and the size of the apparatus can be reduced, without reduction of the sheet service life due to the bending of the dielectric sheet, without the noise or bulky size at the time when the transfer sheet is retained by air sucking or the like.

Figure 12:
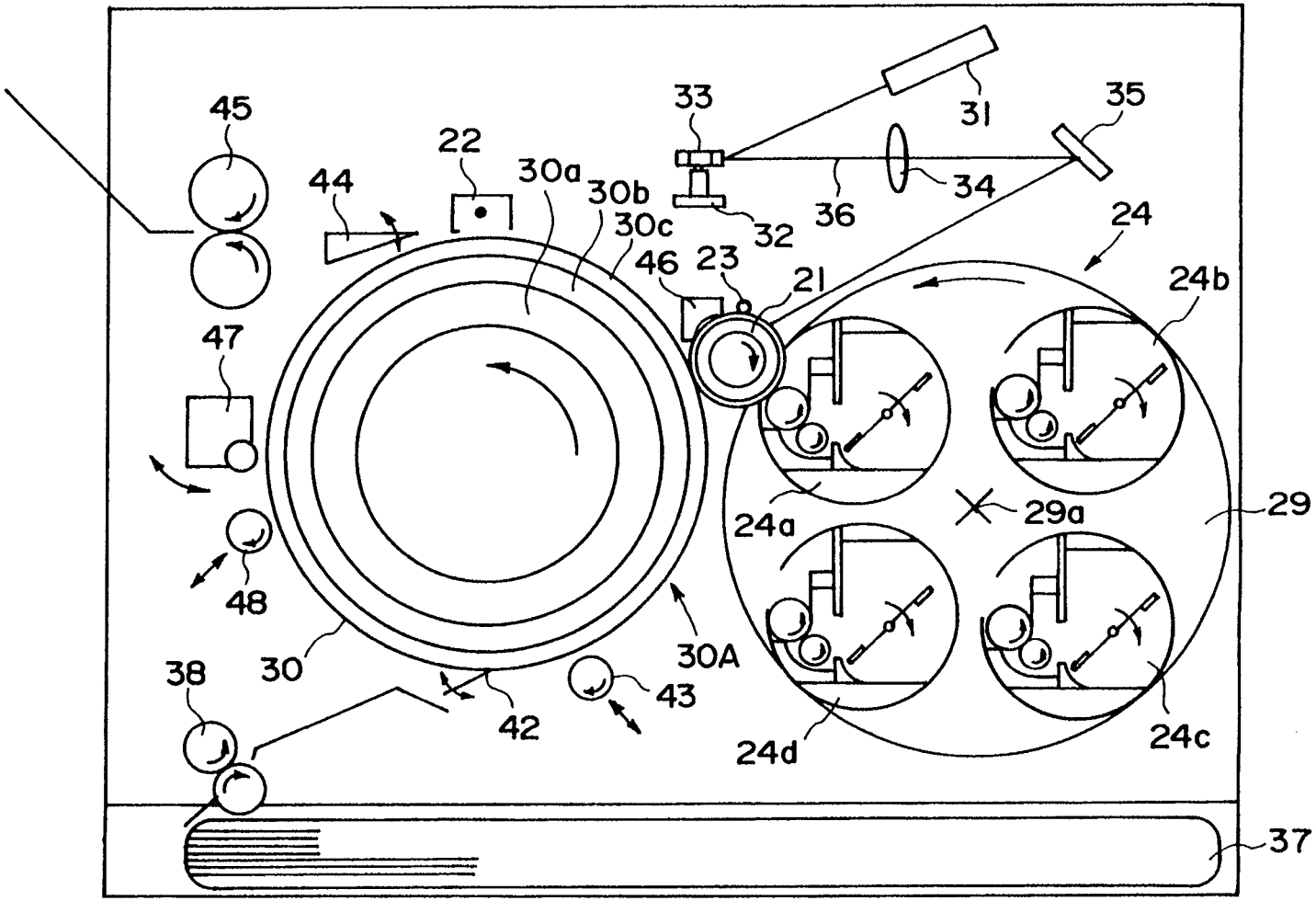
FIG. 12 is a sectional view of an image forming apparatus.

Referring to FIG. 12, an image forming apparatus according to a further embodiment of the present invention will be described. FIG. 12 is a longitudinal sectional view of a color image forming apparatus. As shown in the Figure, the apparatus comprises an image bearing member in the form of a photosensitive drum 21. Around the photosensitive drum 21, there are provided a primary charger 23 in the form of a roller charger, a rotary type developing device 24 having a plurality of developing devices, an image transfer device 30A and a cleaner 46. Above the photosensitive drum 21, there are disposed a laser diode 31 constituting an exposure device, a polygonal mirror 33 rotated by a high speed motor 32, a lens 34 and folding mirrors 35.

The photosensitive drum 21 comprises an aluminum cylinder having a diameter of 40 mm and an organic photosensitive material (OPC) on the outer surface of the aluminum cylinder, the photoconductive member may be replaced with amorphous Si, CdS, Se or the like. The photosensitive drum 21 is rotated in the direction of the arrow in the FIG. 12 at a peripheral speed of 100 mm/sec by an unshown driving means.

The developing device 24 has a supporting member 29 rotatable about a shaft **29*a*. The supporting member 29 carries an yellow developing device 24*a*, magenta developing device 24*b*, cyan developing device 24*c* and black developing device 24*d*. In the developing devices 24*a*, 24*b*, 24*c* and 24*d***, one component yellow toner, magenta toner, cyan toner and black toner are contained.

Figure 13:
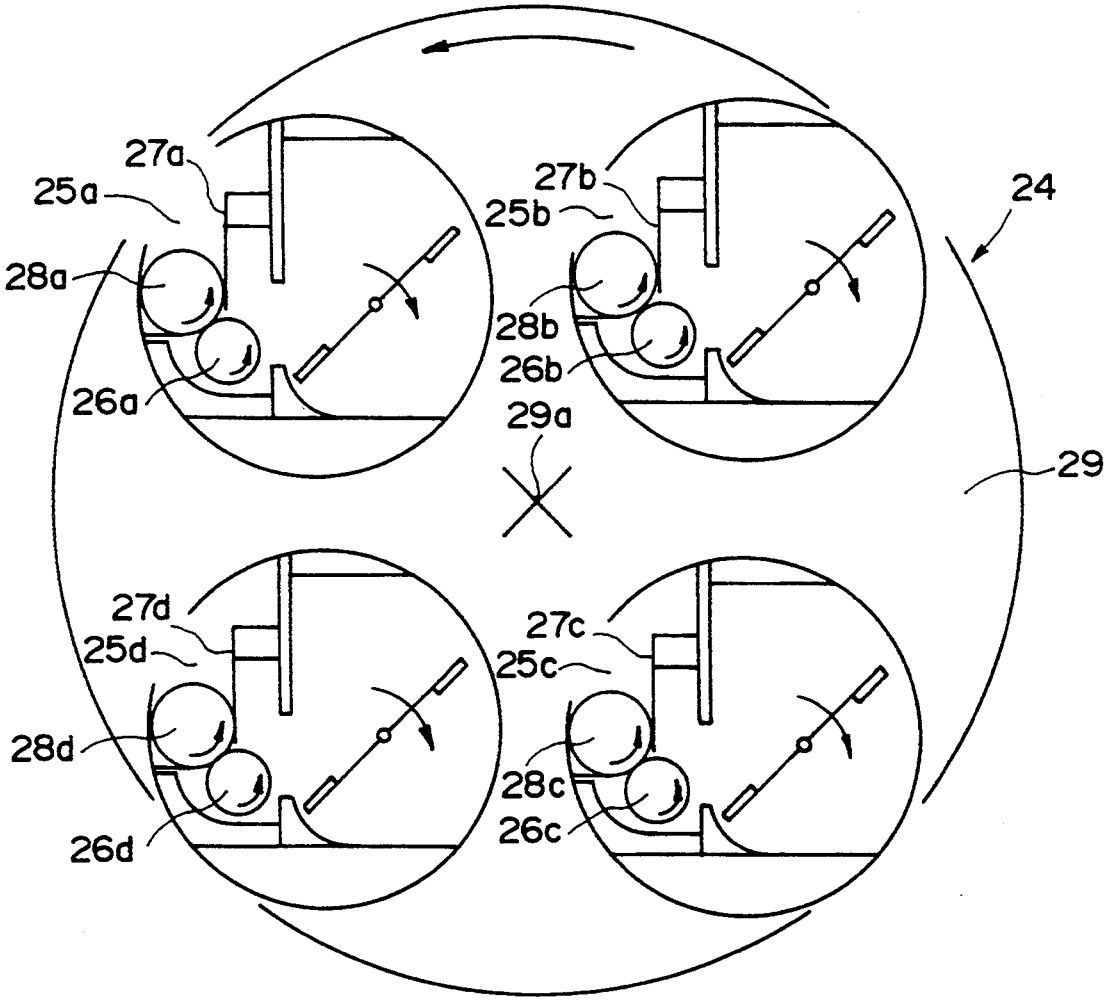
FIG. 13 is a sectional view of a developing apparatus used in the image forming apparatus of FIG. 4.

As shown in FIG. 13, the developing devices **24*a*, 24*b*, 24*c* and 24*d* are provided with developing sleeves 28*a*, 28*b*, 28*c* and 28*d* (developer carrying members) in an openings 25*a*, 25*b*, 25*c* and 25*d*, respectively. The developing devices 24*a*, 24*b*, 24*c* and 24*d* are provided with applying rollers 26*a*, 26*b*, 26*c* and 26*d* and toner regulating members 27*a*, 27*b*, 27*c* and 27*d*. With rotation of the developing sleeves 28*a*, 28*b*, 28*c* and 28*d*, the toner is applied on the developing sleeves 28*a*, 28*b*, 28*c* and 28*d* by the applying rollers 26*a*, 26*b*, 26*c* and 26*d*, respectively. The toner regulating members 27*a*, 27*b*, 27*c* and 27*d* function to regulate the toner particles and also to apply triboelectric charge to the toner particles, thus forming a thin toner layer on the developing sleeves 28*a*, 28*b*, 28*c* and 28*d*, respectively. The toner regulating members 27*a*–27*d***, are preferably made of such a material as to be electrically charged to a polarity opposite from that of the toner particles. More particularly, when the toner is charged to the negative polarity, it is preferably made of nylon or the like, and if it is charged to the positive polarity, silicone rubber or the like is preferable.

The peripheral speed of the developing sleeve **28*a*–28*d* of the developing device 24*a*–24*d*, is preferably 1.0–2.0 times the peripheral speed of the photosensitive drum 21. The developing devices 24*a* 24*d* are moved to the photosensitive drum 21 so that the opened part 25*a*–25*d* is faced to the photosensitive drum 21, when it is faced to the photosensitive drum 21. The detailed driving system for the developing devices 24*a*–24*d***, is disclosed in Japanese Laid-Open Patent Application No. 93437/1975, for example.

The transfer device **30*a* is provided with a transfer drum 30 functioning as a transfer material carrying member. Around the transfer drum 30, there are disposed an attraction roller 43, a discharger 22, a separation pawl 44, cleaner 47 and discharging roller 48. The transfer drum 30 is provided with a gripper 42 for gripping the transfer material at one position on the outer peripheral surface thereof. The transfer drum 30 is rotated in the direction of an arrow substantially at the same peripheral speed as the photosensitive drum 21** by an unshown driving means.

In the structure of the image forming apparatus, the charger 23 is supplied with a voltage of −700 V DC voltage biased with an AC voltage having a frequency of 700 Hz and a peak-to-peak voltage (Vpp) of −1500 V, so as to charge the surface of the transfer drum 21 to approx. −700 V. Then, the laser diode 21 is supplied with a first color (yellow, for example) image signal to produce yellow component image light. The light is projected onto the photosensitive drum 21 through the optical path 36, so that an electrostatic latent image for the yellow image is formed on the photosensitive drum 21 with the light part of −100 V. The electrostatic latent image on the photosensitive drum 21 is carried to the developing device 24, and is developed by an yellow developing device **24*a* in the developing zone into a first color (yellow) toner image on the photosensitive drum 21**.

On the other hand, a transfer sheet is supplied from a transfer material cassette 37 to the transfer drum 30 of the transfer device 30A by a feeding roller 38 in synchronism with the image on the photosensitive drum 21. The transfer drum 30 rotates while gripping the supplied transfer sheet by the gripper 42. Therefore, it feeds the transfer material to the image transfer station where the sheet is faced to the photosensitive drum 21. The transfer sheet fed to the image transfer station receives the yellow toner image from the photosensitive drum 21 by the transfer voltage applied between the transfer drum 30 and the photosensitive drum 21 through the base member of the transfer drum 30 from an unshown voltage source.

By this, the electric charge is injected into the transfer sheet by the transfer voltage, so that the transfer sheet is electrostatically attracted onto the surface of the transfer drum 30. In order to strengthen the electrostatic attraction of the transfer sheet onto the transfer drum 30, the attraction roller 43 is disposed in the vicinity of the sheet feeding position of the transfer sheet to the transfer drum 30 to apply the attraction voltage, so that the transfer sheet is electrostatically attracted after the gripper 42 grips the transfer sheet. This is done in most cases.

The photosensitive drum 21, after completion of the yellow image transfer, is cleaned by a cleaning member such as fur brush, blade or the like of the cleaner 26, so that the surface residual toner is removed. Thereafter, the image forming operation is started again with the primary charging by the charger 23.

The primary charging of the photosensitive drum 21, the formation of the electrostatic latent image by the exposure, the toner image formation by the development of the electrostatic latent image and the transfer of the toner image onto the transfer material, are repeated for the subsequent colors (magenta, cyan and black), so that a color image made of four overlaid toner images (yellow, magenta, cyan and black) is provided on the transfer sheet.

After the completion of the four color toner images, the transfer sheet is electrically discharged by a discharger 22 disposed adjacent to the peripheral surface of the transfer drum 30, and is separated from a transfer drum 30 from a downstream separation pawl 44. Then, it is fed to an image fixing device 45 where it is heated and pressed so that the four color toner images are fixed. The toner images are mixed in the color and fixed on the transfer sheet into a full-color permanent image. Thereafter, it is discharged outside the image forming apparatus. Preferably, the transfer drum 30 from which the transfer sheet is separated, is cleaned by a cleaner 47 having a cleaning member such as far brush, web or the like, so that the residual toner thereon is removed.

Figure 11:
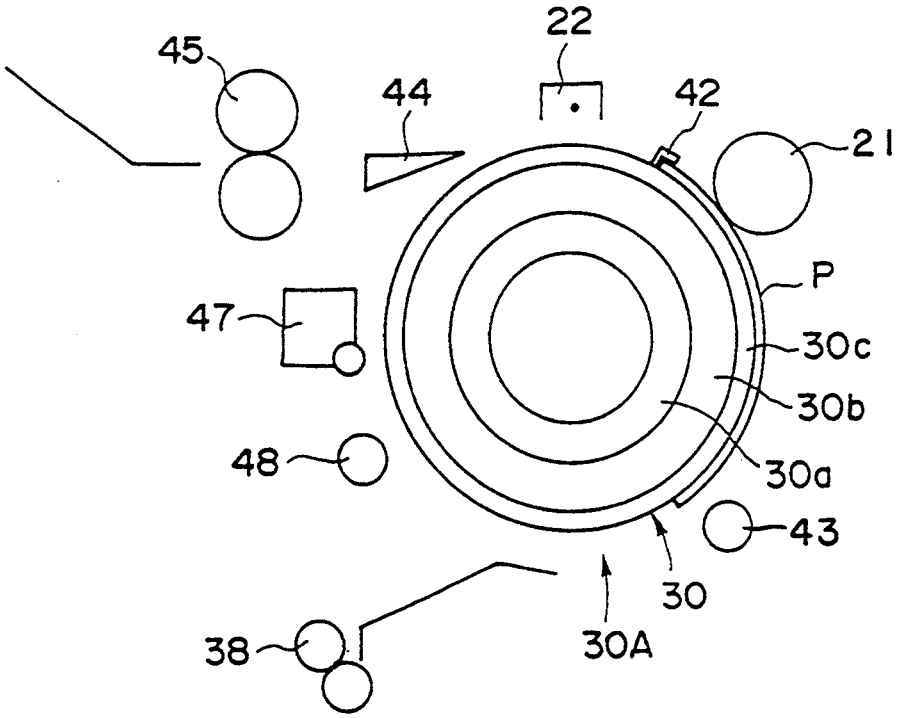
FIG. 11 is a sectional view of a transfer device and parts therearound in an image forming apparatus according to an embodiment of the present invention.

The transfer drum 30 of the transfer device 30A, as shown in FIG. 11, comprises a metal cylinder **30*a*, an elastic layer 30*b* of foamed rubber or foamed resin, and a dielectric layer 30*c*. Thus, it has two layer structure of surface layer including the elastic layer 30*b* and the dielectric layer 30*c*. In this embodiment, the metal cylinder 30*a* has a diameter of 156 mm, and the elastic layer 30*b* is of foamed urethane material available from Inoac Kabushiki Kaisha which has a thickness of 2–3.5 mm and which is wrapped on the metal cylinder 30*a*. The dielectric layer 30*c*** is of PVDF film having a thickness of 100 microns.

In order to strengthen the retention of the transfer sheet P on the surface of the transfer drum 30, the attraction roller 43 is supplied with a voltage of approx. +1 KV–+2 KV. The transfer sheet is strongly attracted onto the surface of the transfer drum 30 by the Coulomb, force produced by the electric charge induced to the transfer sheet P and the dielectric layer **30*c* of the transfer drum 30. For this purpose, the PVDF film of the dielectric layer 30*c*** preferably has a volume resistivity $10^{14}$ ohm·cm and a thickness of 50–100 microns.

The reason why a soft elastic layer **30*b* is formed of a foamed material is that the transfer drum 30 is uniformly and lightly contacted to the photosensitive drum 21, by which the load to the photosensitive drum 21 is reduced. If the volume resistivity of the elastic layer 30*b* of the foamed material is low when the elastic layer 30*b* is of two layer structure on the metal cylinder 30*a* with the dielectric layer 30*c*, the electric charge induced to the dielectric layer 10*c* is not trapped or it is leaked. Therefore, the volume resistivity is preferably relatively high. The volume resistivity of the elastic layer 30*b*** is an intermediate resistivity ($10^4$ –$10^{12}$ ohm·cm approximately).

However, since the elastic layer **30*b* is formed with organic material such as foamed rubber or resin, there is a problem of instability, relative to the ambient condition, of the volume resistivity of the elastic layer 30*b***.

If the volume resistivity of the elastic layer **30*b* is in the higher part in the above-described range, that is, if it is $10^{10}$–$10^{12}$ ohm·cm, it is possible that the transfer sheet P is attracted onto the dielectric layer 30*c* of the transfer drum 30. However, under the low humidity condition (not higher than 40%), a large amount of residual charge remains on the transfer drum 30 after the transfer sheet P is separated. Therefore, in order to attract the next transfer sheet continuously, a high attraction voltage is required with the result that the capacity and size of the power source for the attraction roller 43** is bulky.

When the volume resistivity of the elastic layer **30*b* is in the lower part of the above-described range, that is, it is $10^4$ –$10^{10}$ ohm·cm, the attracting and discharging operations are of no problem under the low humidity condition. However, under the high humidity condition (not less than 60%), the volume resistivity of the elastic layer 30*b* significantly decreases. In the case of foamed urethane material used as the elastic layer 30*b*, for example, the volume resistivity is $10^8$ ohm·cm under 15° C. and 10% humidity (low humidity) condition, whereas under the high humidity condition (30° C., 80%), the volume resistivity lowers to $10^3$ ohm·cm. Therefore, it is difficult to produce and retain in the insulating layer 30c the electric charge required for attracting the transfer sheet P onto the transfer drum 10**.

Therefore, when the volume resistivity of the elastic layer 30b is relatively low ($10^4$–$10^{10}$ ohm·cm approx.), it is required that the leading edge of the transfer sheet P relative to the rotational direction of the transfer drum 30, is gripped by a gripper 42. However, the trailing edge of the transfer sheet P away from the transfer drum 30 due to insufficient attraction, is rotated while being in contact with the discharger 12, the separation pawls 44, the cleaner 47, the discharging roller 48, the attraction roller 43 or the like disposed around the transfer drum 30, with the result of disturbance of the toner image transferred onto the transfer sheet P or contamination of the inside of the image forming apparatus with the toner.

As described hereinbefore, the elastic layer 30b has two functions, namely, to establish the light contact between the photosensitive drum 21 and the transfer drum 30 and to promote the attraction of the transfer sheet P using the intermediate resistance beyond a certain level of the volume resistivity. To establish the light contact between the elastic layer 30b and the photosensitive drum 21, the elastic layer 30b preferably has a hardness of not more than 30 degrees (JIS A), and has a thickness of not less than 3 mm.

However, if the thickness of the elastic layer 30b increases to this extent, the charge moving speed is low in the discharging operation under the low humidity condition, particularly. Then, the discharging operation does not occur smoothly with the result that the electric discharge is not completed before the attraction of the next transfer sheet. As disclosed in Japanese Laid-Open Patent Application No. 59636/1976, the transfer sheet has a laminated structure of the intermediate resistance layer having plural layers (normally two). Therefore, the charge is easily trapped in the transfer sheet. If the charge moving speed is low at the time of discharging, the charge is not easily removed.

In view of the above, it is desired that the required attraction charge is assured on the transfer material carrying member of the transfer device irrespective of the ambient conditions, thus assuring the good attraction of the transfer material on the transfer material carrying sheet, by which the disturbance of the toner image on the transfer material or the toner scattering due to the contact of the separated transfer material is contacted to the elements around the transfer drum, is prevented, and the transfer material carrying member is easily discharged after separation of the transfer material.

Figure 9:
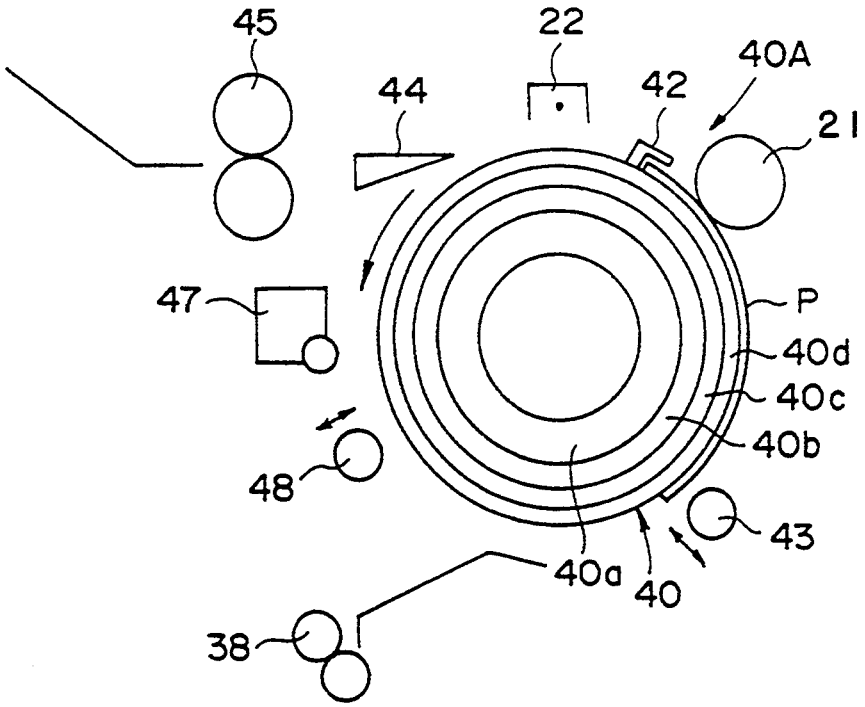
FIG. 9 is a sectional view of a transfer device and parts therearound in an image forming apparatus according to an embodiment of the present invention.

A further embodiment of the present invention to accomplish this will be described. FIG. 9 is a sectional view of a transfer device and the parts therearound of an image forming apparatus according to this embodiment. The transfer drum 40 of the transfer device 40a of this image forming apparatus comprises a metal cylinder (base member) 40a, an electrically conductive elastic layer 40b, an intermediate resistance layer 40c and a dielectric layer 40d. The other structures of the image forming apparatus are the same as in the image forming apparatus of FIGS. 11–13. Therefore, the same reference numerals are assigned in FIG. 9 as in FIGS. 11–13 to the elements having the corresponding functions, and the detailed description thereof are omitted for simplicity. At least in the region carrying the base member, the conductive elastic layer, the intermediate resistance layer and the dielectric layer constitute the laminated structure.

In this embodiment, the transfer sheet P supplied to the transfer drum of the transfer device 40a by the feeding roller 38, is gripped by the gripper 42 of the transfer drum 40 at the leading edge of the transfer sheet P. It is pushed to the transfer drum 40 by the attraction roller 43, and by the voltage (max. −4 KV) applied to the attraction roller 43, it is electrostatically attracted onto the surface of the transfer drum 40. The transfer sheet P attracted on the transfer drum 40 is rotated by the rotation of the transfer drum 40, and is conveyed through the image transfer station faced to the photosensitive drum 21.

Between the transfer drum 40 and the photosensitive drum 21, a transfer voltage is applied to 3.0 KV with increment from 2.0 KV by 0.5 KV for each turn of the transfer drum 40, and the four color (magenta, cyan, yellow and black) toner images are superposedly transferred onto the transfer sheet P in the order named from the photosensitive drum 21.

After completion of the four color toner image transfer, the transfer sheet P is electrically discharged by a discharger 22 supplied with max. 5 KV DC voltage biased with an AC voltage having a frequency of 500 Hz and a peak-to-peak voltage Vpp of 12 KV. Thereafter, the transfer sheet is separated from the transfer drum 40 by the separation pawls 44. It is introduced into the fixing device 45, where the toner image is fixed. Then, the transfer sheet is discharged to the outside of the image forming apparatus. In this embodiment, as described above, the transfer drum 40 comprises an electrically conductive metal cylinder 40a, a conductive elastic layer 40b, an intermediate resistance layer 40c and a dielectric layer 40d in the order named.

In this embodiment, the metal cylinder 40a is an aluminum cylinder having a thickness of 5 mm. On the metal cylinder 40a, an electrically conductive elastic layer 40b is wrapped, the conductive elastic layer 40b being in the form of electrically conductive sponge having a volume resistivity of not more than $10^3$ ohm·cm, a thickness of 3–3.5 mm and a hardness of not more than 30 degrees. The dielectric layer 40d is not closely contacted to or bonded to the intermediate resistance layer 40c. It is PVDF (polyvinylidene fluoride) film having a volume resistivity of $10^4$ ohm·cm and a thickness of 75 microns wrapped on the intermediate resistance layer 40c. The dielectric layer preferably has a volume resistivity of $10^{13}$–$10^{16}$.

The intermediate resistance layer 40c is approx. $10^8$–$10^{14}$ ohm·cm, that is, intermediate volume resistivity which is larger than the volume resistivity of the conductive elastic layer and which is smaller than the volume resistivity of the dielectric layer. The intermediate resistance layer 40c is closely contacted or bonded to the conductive elastic layer 40b. It is formed in this embodiment by spray method on the conductive elastic layer 40b. The intermediate resistance layer 40c in this embodiment has been provided by solving in an organic solvent titanium oxide particles having a volume average particle size of 0.1–0.5 micron and plastic resin material such as butyral resin, acrylic resin, phenol resin, nylon resin, polyester resin or the like, and kneading and dispersing them, and by applying the dispersed liquid by spray gun onto the elastic layer 40b into a thickness of 10–100 microns.

In a specific example of the intermediate resistance layer 40c of this embodiment is provided by spraying on the elastic layer 40b a dispersed liquid comprising 20% of titanium oxide, 5% of butyral resin, 75% of MEK (methyl ethyl ketone) (% by weight), and air-drying it.

In such a transfer drum 40, the electric charge produced in the dielectric layer 40d by the attraction voltage applied to the attraction roller 43, is trapped in the intermediate resistance layer 40c, so that the attraction of the transfer sheet P to the transfer drum 40 surface is promoted. Since the intermediate resistance layer 40c is inorganic material rich (titanium oxide, TiO2), the volume resistivity is stable against ambient condition change. The volume resistivity change of the intermediate resistance layer 40c was $10^{12}$ ohm·cm under 15° C. and 10% condition, and was $10^{11}$ ohm·cm under 32.5° C. and 80% condition.

Thus, the resistance variation of the intermediate resistance layer 40c of this embodiment is very small relative to the ambient condition change, as compared with the volume resistivity change of the elastic layer 30b having the intermediate resistance in the transfer drum 30 shown in FIG. 11. Therefore, it is possible that the transfer sheet P is stably attracted on the transfer drum 40 against the ambient condition change. The separation and contact to the other member of the transfer sheet P, can be prevented, and therefore, the resultant toner image disturbance and the toner scattering, can be prevented. Therefore, according to the present invention, a high quality image can be provided.

In the embodiments of FIGS. 11 and 12, the elastic layer 30b is caused to perform two functions, namely, to establish light contact between the transfer drum 40 and the photosensitive drum 21 and to trap the attracted charge. According to this embodiment, the provision of the conductive elastic layer 40b and the intermediate resistance layer 40c thereon, so that the two functions are separated. That is, the establishment of the light contact between the transfer drum 40 and the photosensitive drum 21 is allotted to the elastic layer 40b, and the intermediate resistance layer 40c functions to trap the attraction charge upon attracting operation of the transfer sheet P. Since the resistance of the elastic layer 40b is low, the electric discharge operation occurs smoothly.

In this embodiment, the intermediate resistance layer 40c and the dielectric layer 40d are not closely contacted or bonded. This provides an air layer therebetween. Therefore, the electric charge produced by the application of the attraction voltage to the attraction roller 43 is trapped in the air layer, so that the electric charges having the opposite polarities are retained at the dielectric layer side 40d and the intermediate resistance layer 40c side of the air layer. As shown in the first embodiment, the gap between the intermediate resistance layer and the insulating layer is preferably not less than 10 microns.

During the discharging operation, the discharging roller 48 is pushed to the transfer drum 40, and the elastic layer 40 and the intermediate resistance layer 40c are compressed, and in this state, the discharging roller 48 is supplied with a discharging voltage. By doing so, the opposite polarity electric charges existing across the air layer at the boundary between the intermediate resistance layer 40c and the dielectric layer 40d, are neutralized with each other, thus removing the electric charges. In other words, the close contact between the low resistance elastic layer 40b and the intermediate resistance layer 40c, the electric discharge is promoted.

Table 1 shows a voltage arising from the residual charge on the transfer drum after the discharging operation in each of the structures of this embodiment and FIG. 11 structures. It will be understood that the residual charge on the transfer drum is significantly reduced according to this invention, from the structures of FIG. 11.

TABLE 1

| | Embodiment | FIG. 11 |
|---|---|---|
| Residual Charge | 50–100 V | 600–1000 V |

The description will be made as to another embodiment of the transfer drum. In this embodiment, in order to further increase the dielectric constant of the intermediate layer 40c of the transfer drum 40 of FIG. 9, barium titanate is dispersed in the intermediate resistance layer 40c. The intermediate layer 40c of this embodiment comprises 15% of titanium oxide, 20% of barium titanate, 5% of butyral resin and 60% of EMK (% by weight). The volume average particle size of the barium titanate was 1–5 microns.

In this embodiment, the dielectric constant of the intermediate resistance layer 40c further increases, so that the charge accumulation amount increases, and therefore, the attraction of the transfer sheet P to the transfer drum 40 is enhanced.

The above advantageous effects, were most remarkable when the content of the barium titanate is 10—30%. If it is less than 10%, the advantageous effects is not enough. If it is larger than 30%, residual electric charge remains on the transfer drum 40 even if the transfer drum 40 is discharged by the discharging roller 48 after the transfer sheet P is separated.

A further embodiment of the transfer drum will be described.

Figure 10:
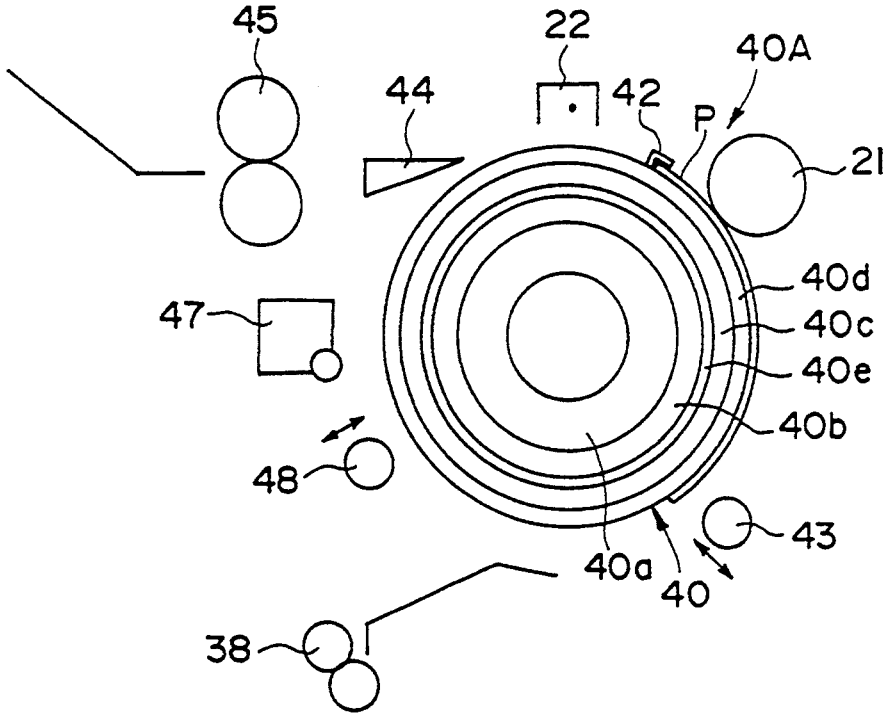
FIG. 10 is a sectional view of a transfer device and parts therearound in an image forming apparatus according to a further embodiment of the present invention.

FIG. 10 is a sectional view of a transfer device and parts therearound in the image forming apparatus of this embodiment. In this embodiment, the transfer drum 40 comprises a metal cylinder 40a, an electrically conductive elastic layer 40b of conductive sponge thereon, an intermediate resistance layer in the form of an intermediate resistance sheet bonded thereon with electrically conductive adhesive 40e, and a dielectric layer 40d of PVDF film thereon.

The conductive elastic layer 40b has a volume resistivity of not more than $10^3$ ohm·cm and a thickness of 3.5 mm. The conductive adhesive 40e has a volume resistivity of $10^3$ ohm·cm or lower and a thickness of 10 microns.

The intermediate resistance sheet constituting the intermediate resistance layer 40c comprises a plastic resin such as polyester resin or fluorine resin or the like in which 20–40% of inorganic material such as titanium oxide, tin oxide, zinc oxide or the like is dispersed. The volume resistivity thereof is controlled to be $10^8$ $10^{14}$ ohm·cm.

With the transfer drum 40 having such an intermediate resistance layer 40c, similar to the foregoing embodiment, the transfer sheet P can be electrostatically attracted and held on the transfer drum 40 with sufficient attraction force. Even after the discharge of the transfer drum 40 after the separation of the transfer sheet P after the toner image transfer, the residual electric charge on the transfer drum 40 is low, so that a high quality color image can be provided.

As will be understood from the foregoing, the important point of this embodiment is that the insulating layer 40*d* and the intermediate resistance layer 40*c* are not close contacted or bonded with each other, but the intermediate resistance layer 40*c* and the elastic layer 40*b* are bonded or closely contacted with each other. By the provision of the dielectric layer 40*d* in the form of insulating film such as PVDF or the like film wrapped on the intermediate resistance layer 40*c*, a microscopic air layer is provided between the dielectric layer 40*d* and the intermediate layer 40*c*. Particularly during the discharging operation, the discharging roller 48 is pressed to the transfer drum 40, while the discharging voltage is applied, by which the opposite polarity electric charges on the dielectric layer side 40*d* and the intermediate resistance layer side 40*c* through the air layer therebetween, are attenuated, so that the discharging is promoted. Therefore, preparation for the next attraction and transfer operation, can be quickly performed. Since the low resistance elastic layer 40*b* and the intermediate resistance layer 40*c* are closely contacted or bonded, the electric discharge of the transfer drum 40 becomes easier.

The image forming apparatus of this embodiment is usable with a process cartridge as disclosed in U.S. Ser. No. 07/946161, for example. The process cartridge may contain at least a photosensitive drum (image bearing member) and another processing means, for example, a developing device, developing devices, cleaning means and/or charging means. Since the service life of the transfer drum of this invention is much longer than the conventional transfer device having a dielectric sheet stretched covering the opening of a cylindrical transfer carrying member, the transfer drum of this invention is suitable with the use of process cartridge, in that the transfer drum can be placed in the main assembly of the image forming apparatus rather than in the process cartridge which preferably contains short service life elements.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

image forming means for forming a toner image on said image bearing member;

a transfer material carrying member for electrostatically carrying a transfer material to a transfer position wherein the toner image is electrostatically transferred at the transfer position onto the transfer material carried on said transfer material carrying member, and wherein said transfer material carrying member comprises a dielectric layer for carrying the transfer material and a supporting member, bonded thereon over less than its entire area, for carrying the dielectric layer, and there is provided an air gap between the dielectric layer and said supporting member where they are not bonded.

2. An apparatus according to claim 1, wherein said supporting member comprises an elastic layer for supporting the transfer material through said dielectric layer and an electrically conductive base for supporting the transfer material through said dielectric layer and said elastic layer.

3. An apparatus according to claim 2, wherein said elastic layer is of a foamed material.

4. An apparatus according to claim 3, wherein said elastic layer has a volume resistivity of $10^4$–$10^{12}$ ohm·cm and has a thickness of 0.5 mm–5 cm.

5. An apparatus according to claim 4, wherein said dielectric layer has a volume resistivity which is larger than that of said elastic layer.

6. An apparatus according to claim 1, wherein the gap at least 10 microns.

7. An apparatus according to claim 1, wherein said dielectric layer has a volume resistivity of $10^{12}$–$10^{17}$ ohm·cm.

8. An apparatus according to claim 1, wherein said dielectric layer has a volume resistivity which is larger than that of said supporting member.

9. An apparatus according to claim 1, wherein said supporting member comprises an intermediate resistance layer for supporting the transfer material through said dielectric layer, an elastic layer for supporting the transfer material through said dielectric layer and said intermediate resistance layer, and an electrically conductive base for supporting the transfer material through said dielectric layer, said intermediate layer and said elastic layer.

10. An apparatus according to claim 9, wherein said elastic layer is of a foamed material.

11. An apparatus according to claim 9, wherein said elastic layer has a volume resistivity not more than $10^4$ ohm·cm.

12. An apparatus according to claim 9, wherein said intermediate resistance layer has a volume resistivity of $10^8$–$10^{14}$ ohm·cm and has a thickness of 10–100 microns.

13. An apparatus according to claim 9, wherein said dielectric layer has a volume resistivity of $10^{13}$–$10^{16}$ ohm·cm.

14. An apparatus according to claim 12 or 13, wherein said dielectric layer has a volume resistivity larger than that of said intermediate resistance layer.

15. An apparatus according to claim 9, wherein said transfer material carrying member comprises an electrically conductive adhesive between said elastic layer and said intermediate resistance layer.

16. An apparatus according to claim 1, wherein said supporting member is supplied with a voltage during image transfer.

17. An apparatus according to claim 1, further comprising attraction means for electrostatically attracting the transfer material on said transfer material carrying member, before image transfer operation.

18. An apparatus according to claim 1 or 17, further comprising discharging means for electrically discharging said transfer material carrying member after image transfer operation.

19. An apparatus according to claim 1, wherein a plurality of color toner images are formed on said image bearing member, the plural color toner images are sequentially transferred superposedly on the transfer material carried on said transfer material carrying member.

20. An apparatus according to claim 19, wherein said apparatus is capable of forming a full-color image on the transfer material.

21. An image forming apparatus, comprising:

an image bearing member;

image forming means for forming a toner image on said image bearing member;

a transfer material carrying member for electrostatically carrying a transfer material to a transfer position, wherein the toner image is electrostatically transferred at the transfer position from said image bearing member onto the transfer material carried on said transfer material carrying member, wherein said transfer material carrying member comprises a dielectric layer for carrying the transfer material, an intermediate resistance layer for supporting the transfer material through said dielectric layer, an electrically conductive elastic layer for supporting the transfer material through said dielectric layer and the intermediate resistance layer, and a supporting member for supporting the transfer material through said dielectric layer, said intermediate layer and said conductive elastic layer, wherein said dielectric layer and said intermediate resistance layer are bonded over less than the entire area.

22. An apparatus according to claim 21, wherein said elastic layer is of foamed material.

23. An apparatus according to claim 21, wherein said elastic layer has a volume resistivity of not more than $10^4$ ohm·cm.

24. An apparatus according to claim 21, wherein said intermediate resistance layer has a volume resistivity of $10^8$–$10^{14}$ ohm·cm and has a thickness of 10–100 microns.

25. An apparatus according to claim 21, wherein said dielectric layer has a volume resistivity of $10^{13}$–$10^{16}$ ohm·cm.

26. An apparatus according to claim 24, or 25, wherein said dielectric layer has a volume resistivity which is larger than that of said intermediate resistance layer.

27. An apparatus according to claim 21, wherein said transfer material carrying member comprises an electrically conductive adhesive between said elastic layer and said intermediate resistance layer.

28. An apparatus according to claim 21, wherein said supporting member is supplied with a voltage during image transfer operation.

29. An apparatus according to claim 21, further comprising attracting means for electrostatically attracting the transfer material onto said transfer material carrying member before image transfer operation.

30. An apparatus according to claim 21 or 29, further comprising discharging means for electrically discharging said transfer material carrying member after image transfer operation.

31. An apparatus according to claim 21, wherein a plurality of toner images are formed on said image bearing member, the plural color images are sequentially transferred superposedly on the transfer material carried on said transfer material carrying member.

32. An apparatus according to claim 31, wherein said apparatus is capable of forming a full-color image on the transfer material.

33. An image forming apparatus according to claim 1 or 2, in which said image forming apparatus is usable with a process cartridge containing a photosensitive member and at least one image processing means.

34. An apparatus according to claim 1, wherein said supporting member is provided in a region where said dielectric member carries the transfer material.

35. An apparatus according to claim 21, wherein said intermediate resistance layer, said conductive elastic layer and said surface layer are provided in a region where said dielectric member carries the transfer material.

36. An image forming apparatus, comprising:

an image bearing member;

image forming means for forming a toner image on said image bearing member;

a transfer material carrying member for electrostatically carrying a transfer material to a transfer position, wherein the toner image is electrostatically transferred at the transfer position onto the transfer material carried on said transfer material carrying member, and wherein said transfer material carrying member includes a surface layer contactable with the transfer material and a supporting member fixed partly to the surface layer and supporting the surface layer, wherein a gap is formed between the surface layer and the supporting member where they are not fixed with each other.

37. An apparatus according to claim 36, wherein said surface layer includes a dielectric layer.

38. An apparatus according to claim 37, wherein said dielectric layer has a volume resistivity which is larger than that of said supporting member.

39. An apparatus according to claim 36, wherein said supporting member including an elastic layer provided in a region where said carrying member carries the transfer material and an electrically conductive base provided across said elastic layer in said region from said surface layer.

40. An apparatus according to claim 39, wherein said elastic layer is of a formed material.

41. An apparatus according to claim 39 or 40, wherein said elastic layer has a volume resistivity of $10^4$–$10^{12}$ ohm·cm and has a thickness of 0.5 mm–5 cm.

42. An apparatus according to claim 41, wherein said dielectric layer has a volume resistivity which is larger than that of said elastic layer.

43. An apparatus according to claim 39, wherein said dielectric layer has a volume resistivity of $10^{12}$–$10^{17}$ ohm·cm.

44. An apparatus according to claim 36, wherein the gap is at least 10 microns.

45. An apparatus according to claim 36, wherein said supporting member includes an intermediate resistance layer in a region where said carrying member carries the transfer material an elastic layer provided across the intermediate resistance layer from the surface layer, and an electrically conductive base provided across the elastic layer from said surface layer.

46. An apparatus according to claim 45, wherein said surface layer includes a dielectric layer, which has a volume resistivity of $10^{13}$–$10^{16}$ ohm·cm.

47. An apparatus according to claim 46, wherein said dielectric layer has a volume resistivity larger than that of said intermediate resistance layer.

48. An apparatus according to claim 45, wherein said transfer material carrying member comprises an electrically conductive adhesive between said electric layer and said intermediate resistance layer.

49. An apparatus according to claim 45, wherein said elastic layer is of a foamed material.

50. An apparatus according to claim 45, wherein said elastic layer has a volume resistivity not more than $10^4$ ohm·cm.

51. An apparatus according to claim 45, wherein said intermediate resistance layer has a volume resistivity of $10^8$–$10^{14}$ ohm·cm and has a thickness of 10–100 microns.

52. An apparatus according to claim 36, wherein said supporting member is supplied with a voltage during image transfer.

53. An apparatus according to claim 36, further comprising attraction means for electrostatically attracting the transfer material on said transfer material carrying member before image transfer operation.

54. An apparatus according to claim 36 or 53, further comprising discharging means for electrically discharging said transfer material carrying member after image transfer operation.

55. An apparatus according to claim 36, wherein a plurality of color toner images are formed on said image bearing member, the plural color toner images are sequentially transferred supposedly on the transfer material carried on said transfer material carrying member.

56. An apparatus according to claim 55, wherein said apparatus is capable of forming a full-color image on the transfer material.

* * * * *

UNITED STATES PATENT AND TRADEMARK OFFICE

CERTIFICATE OF CORRECTION

PATENT NO. : 5,390,012

DATED : February 14, 1995

INVENTOR(S) : TOSHIAKI MIYASHIRO, ET AL.

It is certified that error appears in the above-indentified patent and that said Letters Patent is hereby corrected as shown below:

On title page, item [56] "Reference Cited"

"2156271 6/1990 Japan." should read --2-156271 6/1990 Japan.--;
"2156272 6/1990 Japan." should read --2-156272 6/1990 Japan.--;
"2156273 6/1990 Japan." should read --2-156273 6/1990 Japan.--;
"2156274 6/1990 Japan." should read --2-156274 6/1990 Japan.--;
"2156275 6/1990 Japan." should read --2-156275 6/1990 Japan.";
"2156276 6/1990 Japan." should read --2-156276 6/1990 Japan.--;
"2156277 6/1990 Japan." should read --2-156277 6/1990 Japan.--;
"2291578 12/990 Japan." should read --2-291578 12/1990 Japan.--; and
"3154085 7/1991 Japan." should read --3-154085 7/1991 Japan.--.

UNITED STATES PATENT AND TRADEMARK OFFICE

CERTIFICATE OF CORRECTION

PATENT NO. : 5,390,012

DATED : February 14, 1995

INVENTOR(S) : TOSHIAKI MIYASHIRO, ET AL.

It is certified that error appears in the above-indentified patent and that said Letters Patent is hereby corrected as shown below:

Column 2,
line 30, "put" should read --to put--; and
line 60, "illustrates" should read --illustrates a--.

Column 3,
line 41, "An" should read --A--;
line 48, "description" should read --descriptions--;
line 51, "this" should be deleted;
line 52, "an" should read --a--;
line 57, "an" should read --a--; and
line 58, "socalled" should read --so-called--.

Column 4,
line 25, "an" should read --a--; and
line 41, "Yellow" should read --yellow--.

Column 6,
line 8, ".retaining" should read --retaining--.

Column 7,
line 2, "to" should read --for--; and
line 38, "microns." should read --microns, respectively.--.

UNITED STATES PATENT AND TRADEMARK OFFICE

CERTIFICATE OF CORRECTION

PATENT NO. : 5,390,012

DATED : February 14, 1995

INVENTOR(S) : TOSHIAKI MIYASHIRO, ET AL.

It is certified that error appears in the above-indentified patent and that said Letters Patent is hereby corrected as shown below:

Column 8,
line 48, "$^{1013}$ ohm.cm" should read --$10^{13}$ ohm.cm--.

Column 10,
line 18, "cylinder, the" should read --cylinder. The--;
line 21, "in the" should read --in--;
line 25, "an" should be deleted;
line 34, "an" should be deleted;
line 56, "24a 24*d*" should read --24*a*-24*d*--.

Column 12,
line 7, "far" should read --fur--; and
line 40, "layer 10*c*" should read --layer 30*c*--.

Column 14,
line 2, "description" should read --descriptions--.

Column 15,
line 3, "In a" should read --A--.

Column 16,
line 60, "$10^8$ $10^{14}$" should read --$10^8$-$10^{14}$--.

Column 17,
line 6, "close contacted" should read --in close contact--.

UNITED STATES PATENT AND TRADEMARK OFFICE

CERTIFICATE OF CORRECTION

PATENT NO. : 5,390,012

DATED : February 14, 1995

INVENTOR(S) : TOSHIAKI MIYASHIRO, ET AL.

It is certified that error appears in the above-indentified patent and that said Letters Patent is hereby corrected as shown below:

Column 18,
line 12, "gap" should read --gap is--.

Column 19,
line 21, "of" should read --of a--;
line 31, "claim 24," should read --claim 24--; and
line 60, "or 2," should read --or 21,--.

Column 20,
line 25, "including" should read --includes--;
line 31, "formed" should read --foamed--;
line 46, "material" should read --material,--;
line 58, "electric" should read --elastic--; and
line 64, "resistivity" should read --resistivity of--.

Signed and Sealed this

Sixth Day of June, 1995

Bruce Lehman

BRUCE LEHMAN

*Commissioner of Patents and Trademarks*

*Attest:*

*Attesting Officer*